United States Patent [19]

Stäheli

[11] Patent Number: 4,690,306

[45] Date of Patent: Sep. 1, 1987

[54] DISPENSING DEVICE FOR STORING AND APPLYING AT LEAST ONE LIQUID OR PASTY SUBSTANCE

[75] Inventor: Theodor Stäheli, Reinach, Switzerland

[73] Assignee: Ciba-Geigy Corporation, Ardsley, N.Y.

[21] Appl. No.: 891,826

[22] Filed: Aug. 1, 1986

[30] Foreign Application Priority Data

Aug. 12, 1985 [CH] Switzerland ..... 3456/85
Jan. 17, 1986 [CH] Switzerland ..... 193/86

[51] Int. Cl.[4] ..... B67D 5/42

[52] U.S. Cl. ..... 222/80; 222/137; 222/162; 222/327; 222/389

[58] Field of Search ..... 222/80, 160, 162, 129, 222/135-136, 137, 323-325, 326, 327, 336, 340-341, 386, 387, 389, 504, 511, 518, 544, 545, 559, 567; 251/347

[56] References Cited

U.S. PATENT DOCUMENTS

| | | | |
|---|---|---|---|
| 975,646 | 11/1910 | Sidney | 239/322 X |
| 3,007,611 | 4/1961 | Coolidge | 222/137 |
| 3,813,012 | 5/1974 | Laird | 222/326 |
| 3,910,466 | 2/1975 | Collar | 222/327 |
| 4,215,802 | 8/1980 | Ornsteen | 222/389 X |
| 4,366,919 | 1/1983 | Anderson | 222/137 |
| 4,426,022 | 1/1984 | Lang et al. | 222/130 |
| 4,471,888 | 7/1984 | Herb et al. | 222/137 |
| 4,493,436 | 1/1985 | Brokaw | 222/80 |
| 4,538,920 | 9/1985 | Drake | 366/177 |
| 4,589,572 | 5/1986 | Pomarolli | 222/327 |

FOREIGN PATENT DOCUMENTS

| | | |
|---|---|---|
| 105181 | 4/1984 | European Pat. Off. . |
| 2521392 | 11/1976 | Fed. Rep. of Germany . |
| 2501080 | 9/1982 | France . |

*Primary Examiner*—Joseph J. Rolla
*Assistant Examiner*—Michael S. Huppert
*Attorney, Agent, or Firm*—Harry Falber

[57] ABSTRACT

A dispensing device comprises a cartridge unit with at least two chambers containing liquid or pasty substances and pistons therein being connected with each other by at least one blade adapted for cutting through a dividing wall, between two chambers and separating their contents, only one piston assembly being required which can be operated with a propellant under excess pressure preferably not exceeding 6 bars. As no piston rod is required the construction of the device is very compact. In a first step for actuating the pistons, the cartridge unit is moved forward toward an exit end of the device bearing a discharge nozzle whereby valves in the device are opened and contents from the cartridge unit are conveyed to the discharge nozzle. After each discharge a restoring element returns the cartridge unit to a rearward end position whereby the valves are closed and no contents can leak from the cartridge.

26 Claims, 18 Drawing Figures

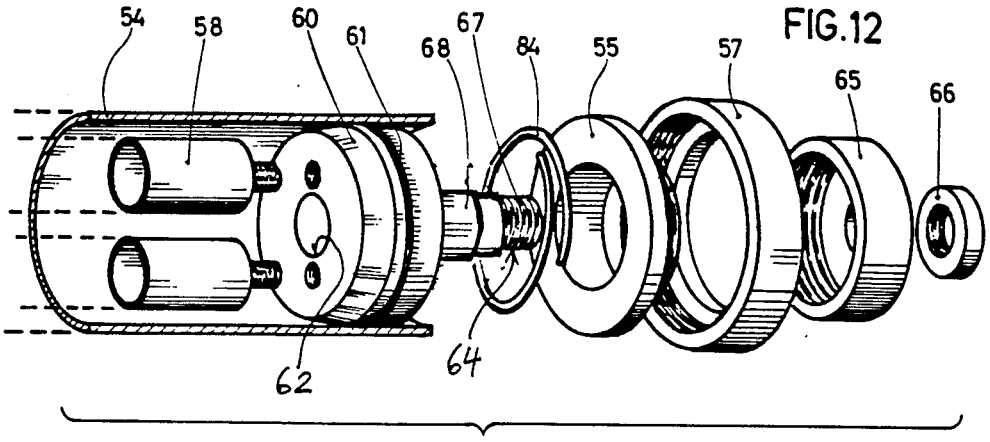
FIG.12
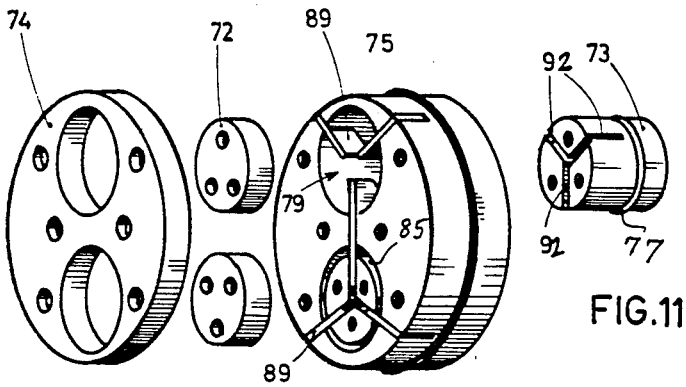
FIG.11
FIG.13
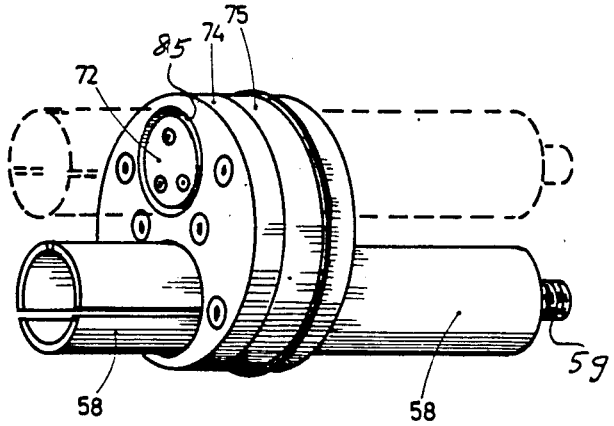

DISPENSING DEVICE FOR STORING AND APPLYING AT LEAST ONE LIQUID OR PASTY SUBSTANCE

BACKGROUND OF THE INVENTION

This invention relates in a first aspect to a dispensing device for storing and applying at least one liquid or pasty substance, which device generally comprises a housing equipped with a dispensing nozzle attached thereto; at least one cartridge being provided with a discharge outlet and with at least one piston for expelling a quantity of the aforesaid substance from the cartridge. More particularly, the invention relates to a dispensing device of the above-described kind, wherein the cartridge is manufactured at least partially from cuttable material; at least two pistons are separated from each other by a cartridge wall and are connected with each other by a coupling unit for joint displacement; and at least one cutting member is mounted behind a forward end plane of the pistons and serves for cutting through the cuttable cartridge wall between the pistons.

In another aspect, the invention relates to a method of using a dispensing device of the above-described particular kind for discharging at least two components with the aid of a propellant of low excess pressure.

Two- or multi-component systems in which two or more substances are stored separately, are mixed each time a quantity thereof is being discharged and are applied to a desired site are being used increasingly as dispensers for adhesives, fillers, foam formers for filling shipping boxes and the like packings for goods susceptible to shock, for the coating of surfaces and for related purposes It is of special importance in the case of known two-component adhesives that a mixing ratio with 10% tolerance is strictly maintained and that both components are being thoroughly mixed with each other. Experience has shown that this rule is frequently being sinned against, due to the fact that the components are sold and stored in tubes. During application, the user discharges the contents of the tube on to a surface, for instance a piece of paper or a plate-like vessel and mixes the components with a stirring rod. Mixing errors will occur especially when only a small amount of adhesive is required, or the components are not being mixed intimately enough. Consequently, the adhesive mixture will not harden properly and the glued parts will not hold together. If the adhesive mixture does not contain enough hardener, it may moreover have a strongly corrosive effect. But even when the preparation is carried out correctly, this method of gluing suffers from certain drawbacks. The various processing steps require much time, in particular the manual mixing of components, and may constitute a cost factor which is not to be neglected. The component mixture being prepared is openly accessible to the air and thus easily contaminated, and the antire handling is therefore objectionable also from a point of view of occupational hygiene. Thus, contact of the hardener with the user's skin may cause dermatoses.

In French Pat. No. 2,501,080 and in U.S. Pat. No. 4,366,919, there have been described apparatus possessing some of the features of the initially-described particular device. In the device according to French Pat. No. 2,501,080, an exit channel unit is provided between the forward end of the cartridge and the rearward connecting end of the discharge nozzle, through which unit the components are transferred from individual cartridge-chambers via separate ducts to the mixing nozzle. Chamber exit orifices of an external chamber are constituted by two diametrically oppositely located passages from which two channels lead radially to the center of the cartridge and from there via an exit channel for the respective component which passes from the central chamber through the latter into a mixing chamber.

Indeed, the known devices mitigate in a certain manner the above-described problems which arise when mixing and dosing the above-mentioned components. Nevertheless, these known devices still suffer in particular from the following drawbacks:

Due to the different viscosities of the components and on account of frictional forces occurring in view of the differently designed pistons of different size, these pistons, acted upon by compressed air of equal pressure, will travel through paths of different length. In order to maintain an exact mixing ratio, it is however required that the pistons travel through paths of equal length. This is only possible if there exists a mechanical connection between the pistons which must be designed in a manner such that it will still exist when the pistons have arrived at the forward end of the cartridge. For this reason, the known devices require structural parts to the rear of the cartridge which correspond approximately to the lengths of the cartridge itself and thus render the entire device heavy and unwieldy.

In another device which is known from German Offenlegungsschrift No. 25 21 392, the space required by the coupling means of the pistons has been considerably reduced. In this device, the interior of the cartridge is subdivided by a cartridge wall constituting a dividing wall which extends longitudinally in the cartridge. This dividing wall is cut open by cutting means moving ahead of the piston which are provided with slots through which the cut-apart portions of the dividing wall are guided. A bridge member serves as piston coupling means holding together the piston which is divided almost completely into two parts, and also carries the cutting blade. This bridge member is provided with suitably designed guiding means permitting the cut-apart portions of the dividing wall to be guided past the bridge.

This complicated construction of the piston-coupling means requires special means for deflecting the cut-apart portions of the dividing wall, thus occupying a considerable share of the available space in the interior of the housing. Moreover, the deflection of the dividing wall parts consumes valuable discharge pressure. This can become problematic in particular in the case of propellant-operated piston dispensers, as official safety regulations permit only relatively low propellant pressures. Furthermore, the deflection process causes a strong deformation of the cartridge walls which are anyhow under severe stress, and leads to problems with regard to the sealing properties of the discharge pistons.

A similar device is described in European Pat. No. 119,847 and comprises two chambers which are formed in a cylindrical housing by a flexible dividing wall which extends longitudinally through the housing and is fastened to the walls of the latter. This dividing wall is cut away or asunder by means of a plunger actuated by a piston of complicated structure, and is moved or stored out of the way in a space rearward of the piston in order not to impede the further advance of the piston. Again, the complicated piston structure, the loss of available space in the housing interior and the increased consumption of operational pressure for actuating the deflecting means for the cut-apart dividing wall portions constitute drawbacks of this known device.

A further problem occurring with the known devices arises in connection with the design of their units for exiting the respective components or substances. For reasons of convenience, their front discharge ends are often left open, especially when the dosing step is only to be interrupted for a short time. However, it is a fact that the individual components show different exiting behavior or leaking when the pistons are not being actuated. A low viscosity substance having many occlusions of air tends more easily to leaking than a highly viscous substance free from occluded air. When the discharge device is left to lie about with its exit orifices open it may happen, for instance, that the hardener will leak from the mixing nozzle when the reactive resin will not do so. This will lead to a disturbed dosing ratio of the components at the very beginning of the next discharge, with all disadvantagesdiscussed further above. Not only will this cause the mixture to be highly corrosive but it will also fail to maintain, for instance, the adhesive strength of an adhesive mixture. Such a device would, however, not be admissible for use in the construction and the repair of vehicles and would be refused approval by a government testing authority.

It is indeed known from the European Pat. No. 105,181 to provide in the exiting unit a valve to be actuated separately from the discharge of the components. However, the manual operation of such a valve would obviously be a complicated one.

OBJECTS AND SUMMARY OF THE INVENTION

It is therefore an object of the invention to provide a discharge device of the initially-described type which avoids the above-described drawbacks of the known devices, which permits a reliable dosing of the components discharged from the respective chambers of the cartridge and which is built from a few elements of the simplest possible construction and which can be manufactured at correspondingly low cost. Moreover, the novel device is to function in a reliable manner and is to permit a simple exchange of cartridges.

These objects are attained by providing in the initially-described particular type of device the arrangement of at least two pistons in a manner such that a gap whose cross-sectional area corresponds to that of the cartridge walls prepared for passing between the pistons, is left free, and that either the cutting means themselves or a connecting flange provided rearward of the cutting means serves as the piston coupling unit and is designed in a manner such that it can be guided with a minimum of friction through the slit produced by the cutting means in the cartridge wall.

An important advantage of the dispensing device according to the invention resides in the fact that the pistons are coupled, either directly by the blades constituting the cutting means or by a thin connecting flange arranged to the rear of the blades, with each other, thus requiring only a minimum of space. As the need for additional space-consuming coupling means has been eliminated, a great flexibility in using the dispensing device has been attained. It thus becomes possible to couple not only two or more pistons arranged in the interior of the cartridge and being separated by dividing walls therein, but even pistons which are arranged outside the cartridges. The piston-coupling means are very simple to manufacture. There is no need for force-consuming deflecting means, and neither the cartridges nor dividing walls therein need be deformed, naturally with the exception of the necessary slitting of the dividing walls. Consequently, the sealing of the pistons does not cause any problems.

In a preferred embodiment of the dispensing device according to the invention, pneumatically or hydraulically operated piston dispensers are provided with component-expelling pistons which are guided outside the cartridge walls. In this arrangement a pressure transmission can be achieved at a ratio such that operation of the dispenser becomes possible even when the viscosity of the substances to be dosed is relatively high and the avoidable propellant pressure is low. Moreover, the pistons guided outside the cartridges can be used to produce a counter pressure to that of the plungers displaced in the interior of the cartridges so that a high sealing effect can be attained in spite of smaller unevenness of the cartridge walls and in spite of deforming forces acting upon the cartridge walls owing to high inside pressure.

A further very important advantage of the dispensing device according to the invention resides in the arrangement of valve elements in the region of the exit channel sector in connection with the actuation of the valves by longitudinal displacement of the cartridges. The cartridges are preferably mounted on a cartridge sled which is located in the housing in the most forward region of the same and can be displaced therein by a limited length of travel in longitudinal direction. In this case the valves are closed when the cartridge sled is in rearmost position to be considered as the rest position, while they are open in the foremost sled position to be considered the working or discharge position.

The cartridge sled is held in the rest position either by stop means or by spring means biassing it toward that position. As the valves are closed in this position, the contents of the cartridge can not be expelled when a driving force acts upon the discharge pistons, so that the driving force first acts to effect a forward displacement of the cartridge sled. Only further forward movement will the open the valves, and the contents of the cartridge can exit. During a discharge step the pressure forces exerted by the discharge pistons hold the cartridge sled in its foremost position. As soon as pressure on the discharge pistons ceases, restoring elements effect the return of the cartridge sled to its rearward end position and the valves are closed again.

BRIEF DESCRIPTION OF THE DRAWINGS

Further objects and advantages of the invention will become apparent from the following more detailed description thereof in connection with the accompanying drawings in which

FIG. 11 is an exploded view in perspective of another embodiment of the piston means shown in FIGS. 9*a*, 9*b* and 10;

FIG. 12 is an exploded view in perspective of the mounting means for the assembled piston means;

FIG. 13 is a view in perspective of the plunger at the instant of penetrating into the cartridge;

Figure 1:
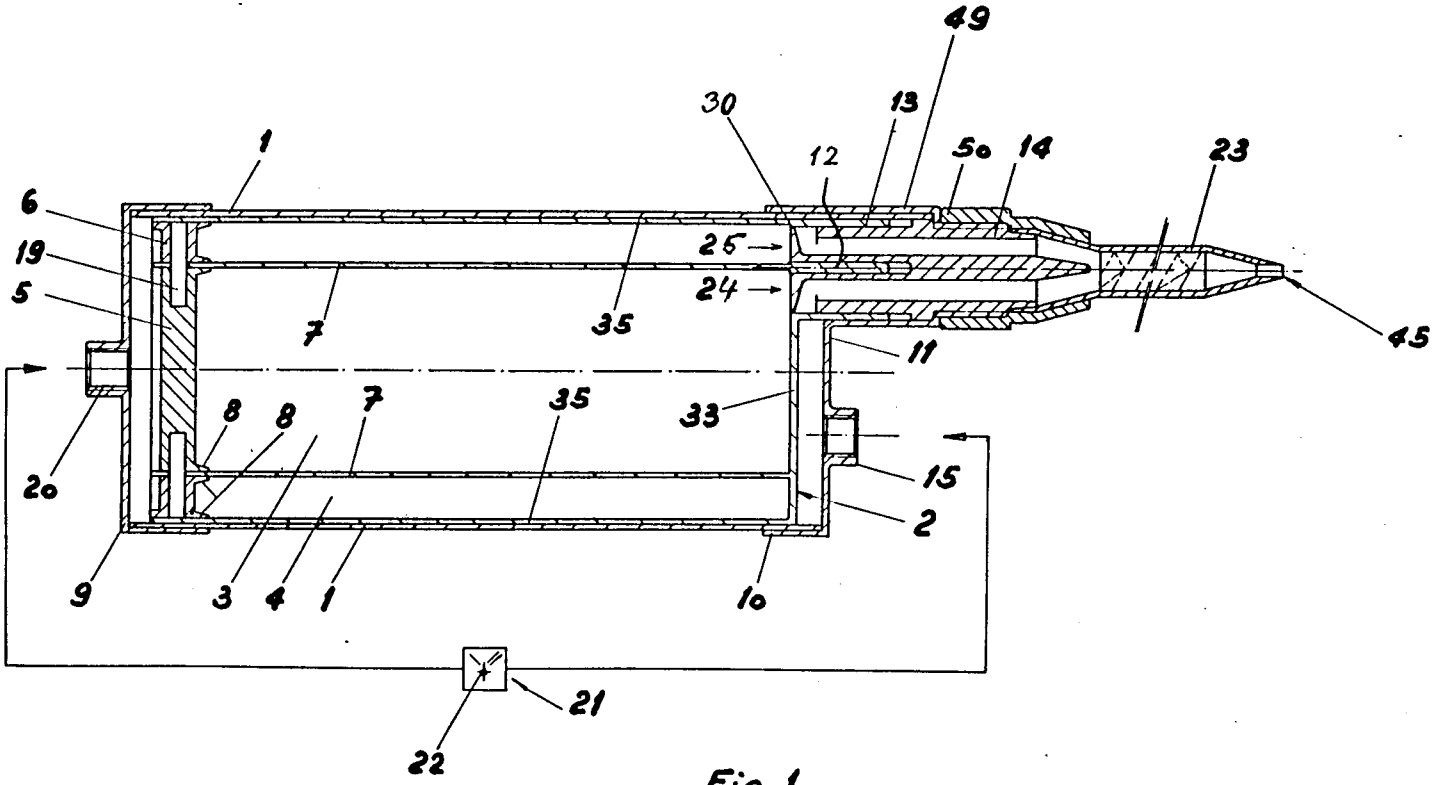
FIG. 1 is a schematic representation of a first embodiment of the dispensing device according to the invention in an axial sectional view.

The terms "forward" and "rearward" where they occur in this specification and the appended claims refer to the direction in which material to be dispensed passes from rearward storage chamber means forwardly into an exit conduit and out of the forward discharge outlet thereof. "Upper" and "lower" refer to the position of the respective parts as illustrated in the drawings without being restrictive to those particular positions.

DETAILED DESCRIPTION OF THE EMBODIMENTS SHOWN IN THE DRAWINGS

The embodiment of the dispensing device illustrated in FIG. 1 comprises a supporting tubular shell 1, a forward front cover 11 which comprises a rearwardly open rim flange 10 which is internally threaded to fit on to a corresponding external thread on the forward end portion of the housing shell 1, so that the cover 11 can be firmly screwed thereon. At its rearward end, the tubular shell 1 bears a closing lid 9, connected to the shell by similar screw means.

In the interior of the supporting tubular shell 1, there is lodged a cartridge 2 being built with a double wall, namely, an external cartridge wall 35 and an internal tubular wall 7 which surrounds a cylindrical central chamber 3 which can be charged with a component to be dispensed, e.g. a synthetic hardenable resin or prepolymerizate. Between the external cartridge wall 35 and the internal wall 7 there is defined an outer annular cylindrical chamber 4, which can be charged with a second component to be dispensed, e.g. a hardening agent reactive with the first component. The chamber walls 7 and 35 must be made from a suitable material which is inert to both the reactive resin and the hardener components. The two chambers 3 and 4 are closed partly at their forward end by a front wall 33 of the cartridge 2. At their rearward end, the central chamber 3 is equipped with a plunger 5 of circular cross section, and an annular piston 6 is lodged in the annular chamber 4. The plunger 5 and piston 6 are provided with annular sealing gaskets 8 respectively.

The plunger 5 and piston 6 are connected with each other by four blades 19 extending radially from the outer periphery of the annular piston 6 into the body of the plunger 5. Two of these four blades, which are arranged with their sharp edges forward at angles of 90° relative to each other, are shown in FIG. 1. These blades 19 allow the plunger 5 and piston 6 to advance in unison in their respective chambers while the blades 19 connecting them cut through the internal wall 7 of the cartridge 2. Wall 35 may be of the same material.

Adjacent its periphery, the cartridge front wall 33 bears out of center a sleeve-shaped cartridge mouthpiece 13 which projects into the interior of, and is surrounded by, a corresponding sleeve part or socket 49 of the housing cover 11. The chambers 3 and 4 can be connected with the interior of the mouthpiece 13 by passageways which are controlled in a manner to be described hereinafter. The internal tubular wall 7 has a forward flat extension or nose part 12 which extends into the mouthpiece 13 preferably in a central plane of the latter indicated by a phantom line in FIGS. 1 to 7. This internal wall nose part 12 subdivides the interior of the mouthpiece 13 into two separate exits 24 and 25 and acts as a barrier between two reactive components, exit 24 being an outlet for a first component from the central chamber 3, and exit 25 being an outlet for the other component from the annular chamber 4 of the cartridge 2.

A valve body 14 is inserted into the mouthpiece 13 from the open forward end of the latter. This valve body 14 can be fastened at the socket 49 of the housing cover 11 by means of a screw cap 50, and shall now be described in particular with reference to FIGS. 2 and 3. A mixing nozzle 23 is fastened by means of the same screw cap 50 on to the forward externally threaded mouth part 32 of the valve body 14. The forward housing cover 11 further bears a connecting socket 15 for the introduction of compressed air. Likewise, the closing lid 9 which is screwed on to the rearward end of the supporting shell 1 bears a similar socket 20 for compressed air.

Figure 2:
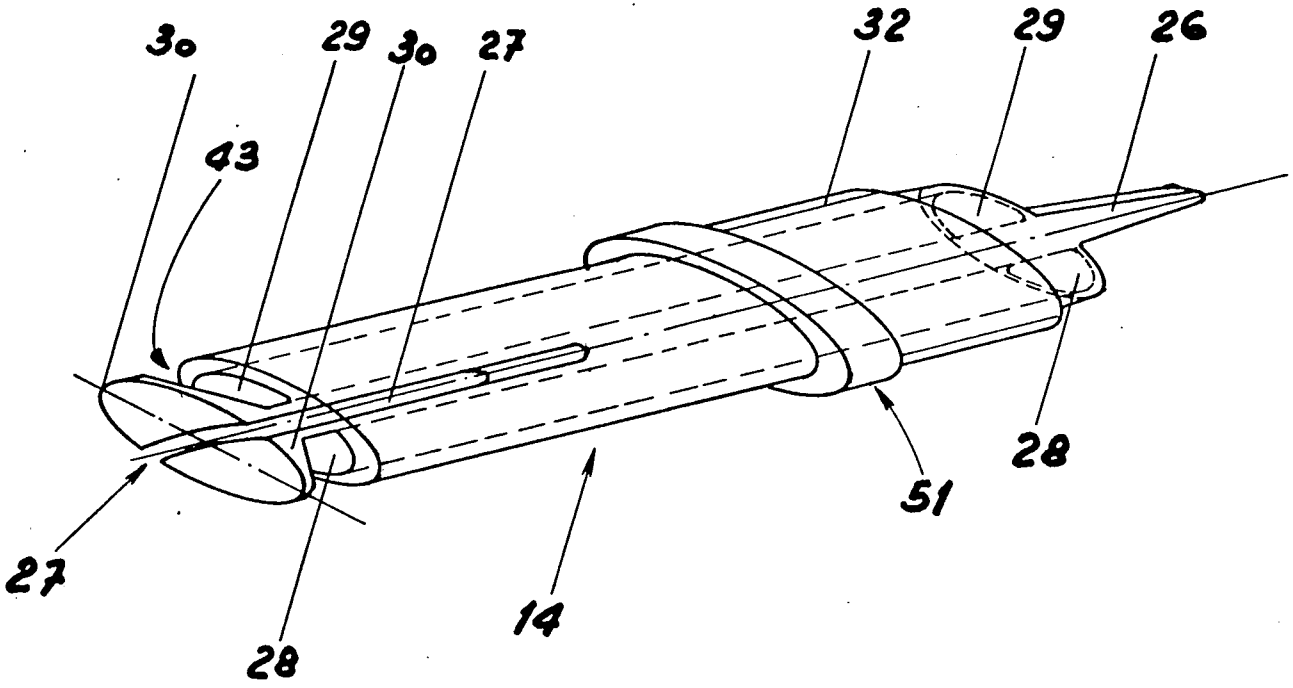
FIG. 2 is a perspective view of the valve means in the embodiment shown in FIG. 1.

The valve body 14, shown in perspective in FIG. 2, is provided with two valve channels 28 and 29 whose rearward entry orifices are shown and which are indicated by dashed lines in the interior of the valve body 14. In a rearward end portion of the valve body there is provided a rearwardly opening axially extending recess or slot 27 into which the flat nose part 12 of the cartridge inner wall 7 can be inserted. Above and below the rearward end of the slot 27 the valve body comprises two sealing vanes 30 which are together of such cross sectional area and configuration that they can obturate completely the entire cross sectional area of the exits 24 and 25 of the two chambers 3 and 4, respectively, when the valve body 14 is in the exit-closing position shown in FIG. 1.

Figure 4:
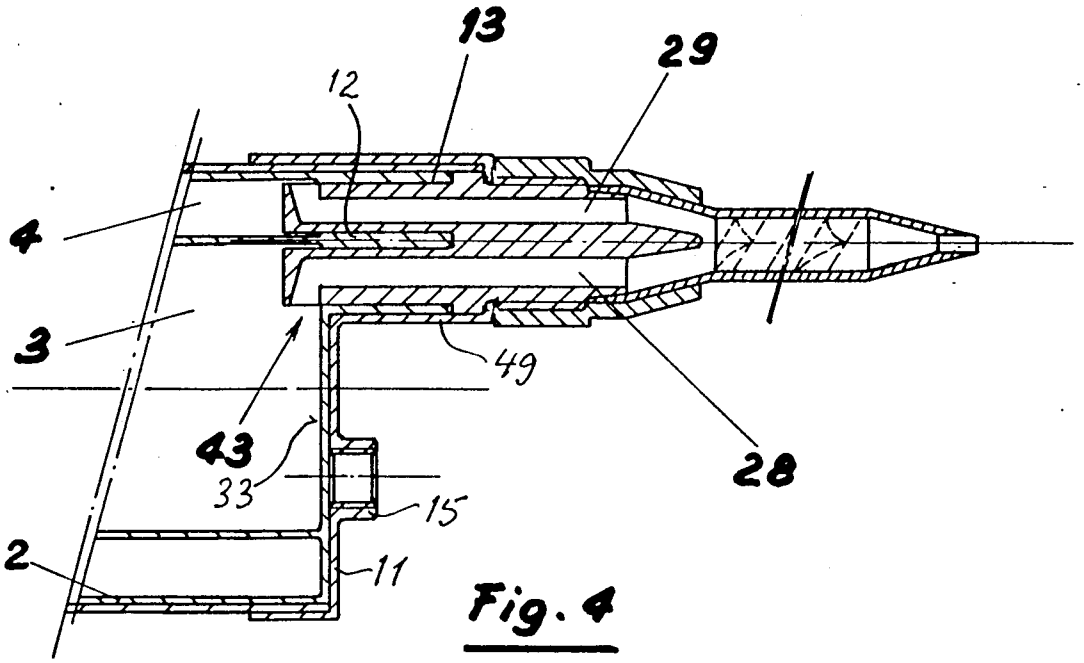
FIG. 4 shows the position of the valve means in the same embodiment as shown in FIG. 1, with the cartridge in forward position.

Adjacent and just forward of the two flaps 30, the two channels 28 and 29 have lateral valve orifices or slots 43 in the hull of the valve body 14. These will permit the influx of components from the chambers 3 and 4, respectively, via the exits 24 and 25 thereof, when the valve body has been moved rearward axially with guidance by the flat internal wall nose part 12 (FIG. 4). In the forward region of the valve body 14 the same bears an annular flange 51 projecting radially from the cylindrical surface of the valve body and having a forward shoulder which abuts against the rearward side of an inwardly turned flange at the forward end of the housing socket part 49. The rearward end of the screw cap 50 which is fully screwed on to the external threading 32 on the part of the valve body 14 forward of the annular flange 51, and clamps in that flange between its rearward screw cap end and the aforesaid forward flange shoulder, thereby fastening the valve body 14 securely in the housing socket part 49. A static mixing nozzle 23 (also shown in FIG. 1) is fastened on the threaded forward part 32 of the valve body 14 by means of the same screw cap 50. At its foremost end the valve body 14 bears an axially forwardly extending flat dividing wall part 26 whose function will be explained more in detail further below.

Figure 3:
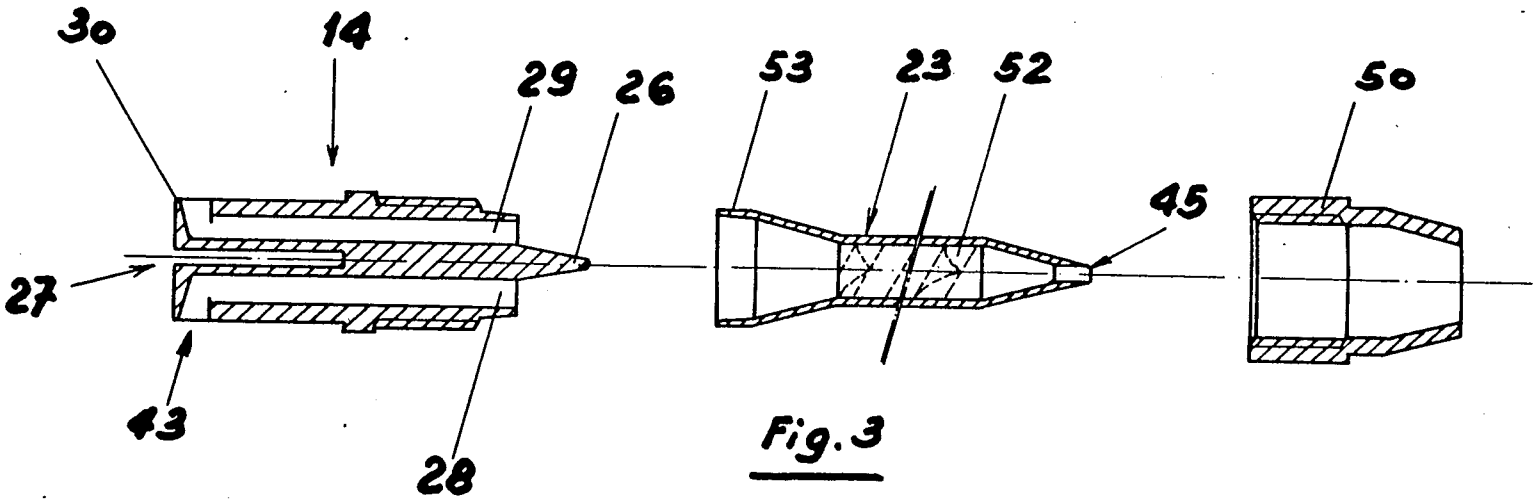
FIG. 3 is an exploded, axial sectional view of the main components of the discharging conduit being part of the embodiment shown in FIG. 1, on an enlarged scale.

The exploded view of the exit means illustrated in FIG. 3 shows in which manner the mixing nozzle 23 is mounted on the valve body 14 by means of the screw cap 50. The axial sectional view of the valve body 14 shows the two axial product channels 28 and 29 being open at the forward valve body end, the two obturating vanes 30 at the rearward valve body end, and the two entry orifices 43 of the channels 28 and 29. The rearward end of the mixing nozzle 23 is designed as a conically rearwardly enlarging and open funnel-like end part 53 which fits with liquid-tight seal on to a similarly forwardly conically tapered front end zone of the valve body 14 about the forward open ends of the channels 28 and 29 which are thus in free communication with the interior of the funnel-like end part 53 of the mixing nozzle 23. The forwardly projecting nose part 26 of the valve body 14 extends into the said interior of the funnel-like nozzle part 53 and keeps the two components separate while they pass through that interior. In a static mixing channel 52 in the forwardly adjacent central cylindrical part of the mixing nozzle 23 there are provided a plurality of mixing elements. The designation of this part of the mixing nozzle 23 as "static" states that it does not contain any movable members. Furthermore FIG. 3 shows the screw cap 50 with its rearward internally threaded portion and its forward, conically tapered portion.

FIG. 4 illustrates the "open position" of the device attained by an axial displacement relative to each other which has taken place between the valve body 14, on the one hand, which can be considered a part of the stationary housing of the device as it is firmly mounted in the housing socket part 49, and the cartridge 2 whose internal wall nose part 12 now fills the entire recess 27 in the valve body 14 which it did not yet do in the "closing" position shown in FIG. 1. In this "open" position the front wall 33 of the cartridge 2 abuts on the forward-end cover 11 of the housing. In this position shown in FIG. 4, the valve body 14 extends further rearwardly into the cartridge 2 so that the obturating vanes 30 have freed the exits 24 and 25, whereby components from the chambers 3 and 4 can pass into the channels 28 and 29 through their entry orifices 43.

Figure 6:
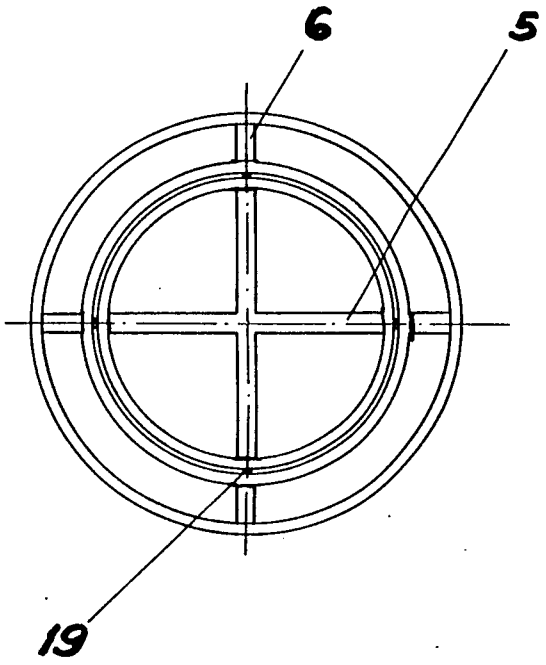
FIG. 6 is a frontal view of the piston means shown in FIG. 5.
Figure 5:
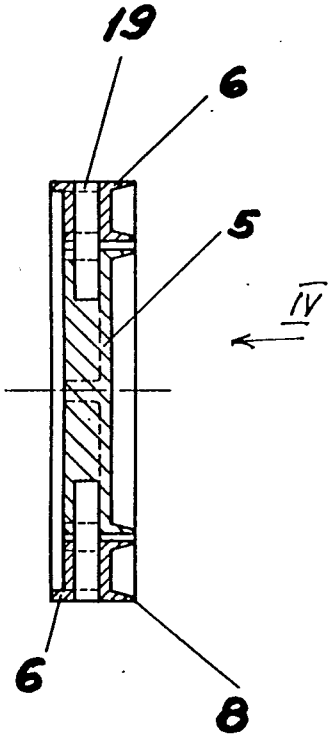
FIG. 5 is a partly sectional view of the piston means of the embodiment shown in FIG. 1, on an enlarged scale.

The section view of the piston unit illustrated in FIG. 5 shows the annular piston 6 surrounding the plunger 5. The two members 5 and 6 are firmly connected for movement together by means of blades 19 whose cutting edges are turned forwardly toward the cartridge front wall 33. The plunger 5 bears on the side thereof facing toward the same front wall 33 a circumferential axially protruding annular sealing gasket or flange in sealing contact with the inner surface of the tubular wall 7, and the annular piston 6 bears on the same side as the plunger 5 similar annular sealing flanges 8 along its inner and outer periphery, of which the inner sealing flange is in sealing contact with the outer surface of the internal tubular wall 7, while the outer flange is in sealing contact with the inside surface of the external cartridge wall 35. A plan view of the forwardly facing front walls of the plunger 5 and the annular piston 6, being arranged coaxially about the former, as well as of the four blades 19 by means of which the two piston members 5,6 are connected with each other is shown in FIG. 6.

The functioning of this first embodiment of the mixing and dispensing device according to the invention shall now be explained in more detail. By actuating an actuating button or lever (not shown) a switching member 22 of a schematically represented three-way valve 21 is moved to a first position designated by I in FIG. 1. Thereby, compressed air is being introduced into the rearward connecting socket 20 and initially urges the entire cartridge 2 including the cylindrical walls 7 and 35 and the front wall 33 together with the piston unit 5,6,19 forward until the cartridge front wall 33 abuts against the frontal cover 11 of the housing of the device. The forward displacement of the cartridge 2 causes the rearward portion of the valve body 14 to penetrate into the interior of the chambers 3 and 4 rearwardly out of the cartridge mouthpiece 14. This position of the forward parts is shown in FIG. 4.

In a second phase, the piston unit 5,6,19 is moved relatively to the cartridge 2, advancing forward in the latter as the blades 19 cut progressively the internal wall 7 into segments. At the cutting zones there will be no escape of component material because the cutting edges of the blades 19 are preceded by the sealing flanges 8 at the frontal faces of the plunger 5 and the annular piston 6, respectively. As the cartridge is destined to be used only once, it is immaterial that the internal wall 7 is being cut up. Due to the simultaneous pressure of the piston unit 5-6-19 acting concurrently on the components in the cartridge chambers 3 and 4, these components are both squeezed forward into the entry orifices 43 of the two valve channels 28 and 29, respectively, and through the latter into the mixing nozzle 23. In the nozzle 23 they are mixed in a mixing channel 52 thereof and the resulting mixture can then exit through a discharge orifice 45 and be applied in a desired amount to a desired site.

As soon as the actuating member is no longer activated, in order to interrupt the dosed discharge of components, the switching member 22 will shift to the position designated by II in the valve 21, and compressed air will now be introduced into the connecting socket 15 in the cover 11 of the housing in an amount sufficient to push the cartridge 2 rearward until the parts thereof with the exception of the piston unit 5-6-19 have reached again the position shown in FIG. 1. The valve channel entry orifices 43 are then again obturated by the valve vanes 30 whose semi-circular sealing rims will again close off the exits 24 and 25, leading from the chambers 3 and 4, respectively, into the cartridge mouthpiece 13. Thus, no more component material can reach the mixing nozzle 23.

A clean separation of the reactive components until the very instant of mixing them is thus made possible with a few inexpensive constructional elements. The cartridge, as a throw-away element, does not require any threading which would increase costs of manufacturing the same considerably. The internal separating wall 7 in the cartridge 2 extends into the cartridge mouthpiece 13 with its flat wall nose part 12 which is received in the slot 27 of the valve body 14, whose valve nose part 26 in turn keeps the components separated from each other until they reach the static mixing channel 52 in the mixing nozzle 23. The mixing nozzle 23 which can be used as a throw-away element in the same manner as the cartridge 2, does not require an expensive threading either.

As soon as the cartridge has reached its rearward position shown in FIG. 1, the compressed air can be turned off. In its rearward position, the cartridge is locked down by conventional locking means (not shown) such as notches in the cartridge wall with which the stationary rims of the obturating vanes 30 can become engaged.

A reduced excess pressure of the compressed air suffices for causing a rearward movement of the cartridge 2. This is of importance especially when removing the cartridge 2 from the device, as it prevents the cartridge from being ejected like a bullet from the device when the rearward closing lid 9 is taken off.

One-way pressure bottles are advantageously used as a propellant source and permit working within a pressure range of 4 to 6 bar. Thereby, highly viscous two-component adhesive mixtures can be prepared without problems.

In order to be able to operate the pistons 5 and 6 as easily as possible, they are manufactured from a material having a very low coefficient of friction such as, for instance, polybutylene terephthalate (PBTB) which is distinguished moreover, by excellant dimensional stability as well as high creeping strength. The cartridge 2, or at least its internal tubular wall 7, is optimally made of polyethylene, polypropylene or polybutyleneterephthalate. These materials are not only relatively inexpensive and can be cut easily, but they are also distinguished by a high resistance to chemicals.

Figure 7:
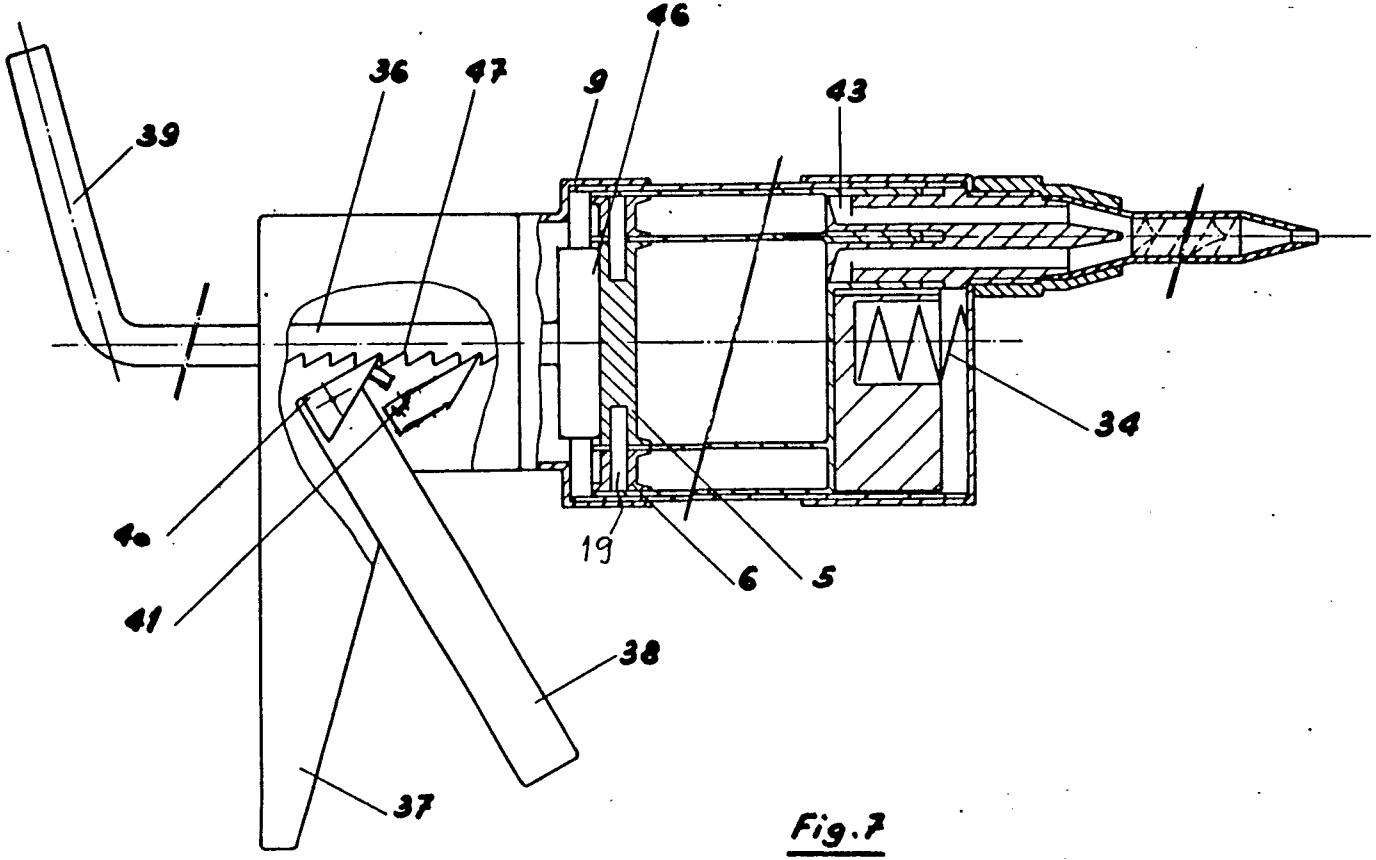
FIG. 7 shows schematically another embodiment of the dispensing device according to the invention, which device is actuated by purely mechanical means, and is shown in partly axial sectional view.

FIG. 7 shows a further embodiment of the device according to the invention which is operated purely mechanically. In this embodiment, a handle 37 is attached rearwardly to the closing lid 9, while the entire forward part of the device is identical with the pneumatically operated first embodiment with the exception of a restoring spring 34 being provided as a restoring means. A rack 36 is mounted in the handle 37 and serves for actuating the pistons 5 and 6, whose forward movement is effected by means of an advancing pawl 40 which is fastened on an actuating lever 38. In order to prevent rearward displacement of the rack 36, there is provided a stop pawl 41. At its rearward end the rack 36 bears a return handle 39, and at its forward end it bears a plunger disk 46 which serves for transmitting the forward pressure of the rack 36 to the entire surface of the plunger 5 and via the blades 19 at the same time to the annular piston 6.

The purely mechanical operation of this embodiment is effected in the following manner:

By depresing the actuating lever the advancing pawl 40 is moved forward and exercises a pressure on the rearwardly facing shoulder of a cog 47 of the rack 36 pushing the latter forward until the pawl 40 drops below that shoulder. The length of the forward movement of the rack 36 is so dimensioned that, during the first part of its travel, the cartridge 2 is moved so far forward that the valve entry orifices 42 register with the interior of the chambers 3 and 4, respectively. During the second part of its travel the piston unit 5-6-19 penetrates by a determined length into the interior of the cartridge chambers 3 and 4 which is sufficient to press a determined dose of substances into the mixing nozzle 23. As soon as the advancing pawl 40 is disengaged from the cog 47, the restoring spring 34 urges the cartridge 2 again toward the rear, whereby the valve entry orifices 43 are again obturated in the cartridge mouthpiece 13 cutting off communication between the interior of the chambers 3 and 4 on the one hand, and the valve channels 28 and 29, on the other hand. In order to prevent further rearward movement of the rack 36 and, thereby, of the piston unit 5-6-19, the stop pawl 41 becomes engaged in a cog 47 of the rack 36 being biassed to do so by conventional biassing means not shown in FIG. 7. The actuating ratio between the advancing pawl 40 and the stop pawl 41 is such that, on the one hand, the entry orifices open and close promptly and that, on the other hand, a sufficient amount of substances is discharged for application to a chosen site.

When inserting a new cartridge the rack 36 must be returned to its rearward end position. For this purpose the return handle 39 is turned about an angle of 90°, so that the rack 36 is no longer blocked by the stop pawl 41, and is then pulled into its starting position.

When filling the cartridge chambers the use of dip tubes is recommended in order to guarantee a filling as free of air bubbles as possible. The dip tubes are inserted into the chambers of the cartridge 2 by way of the mouthpiece 13 of the latter. It is important, especially in the case of highly viscous substances, that the air being replaced in the chambers can escape as completely as possible. It is therefore recommended to evacuate the interior of the cartridge before and during the filling operation.

It will, however, not be possible to fill the cartridge chambers in a convenient manner if the orifices in the cartridge mouthpiece are as small as they are made in the practical embodiment of the initially described known device. Thanks to the advantageous design of the valve means in the dispensing device according to the invention the orifices in the cartridge mouthpiece can have sufficient size to guarantee an unobstructed filling of the cartridge 2.

Furthermore, the central plunger of circular cross section and the annular piston can each bear on the sides thereof exposed to compressed sealing cuffs which prevent outside air from contact with the reactive resin and the hardener, respectively, inside the cartridge.

The above-described coaxial arrangement of the cartridge chambers does indeed enable a very compact construction of the dispensing device; however, it also contributes the following difficulties thereto:

(a) When filling the cartridge the frontal flow line in the annular chamber is asymmetrical so that occlusion of air is unavoidable;

(b) due to the thickness of the wall, the surface of the dividing wall of the annular chamber on the side thereof facing toward the annular chamber is larger than on the side thereof facing the central chamber, and consequently, when equal pressure is applied to the pistons, the pressure in the annular chamber is larger that that in the central chamber. The latter is therefore slightly compressed in the middle thereof, which fact leads to problems of stability and thereby to dosing errors;

(c) a cartridge having coaxial chambers is relatively expensive to manufacture;

(d) commercially available cartridges are as a rule not suitable for use in the dispensing device according to the invention; and, moreover, (e) a special cartridge must be built for each different mixing ratio desired.

Figure 8A:
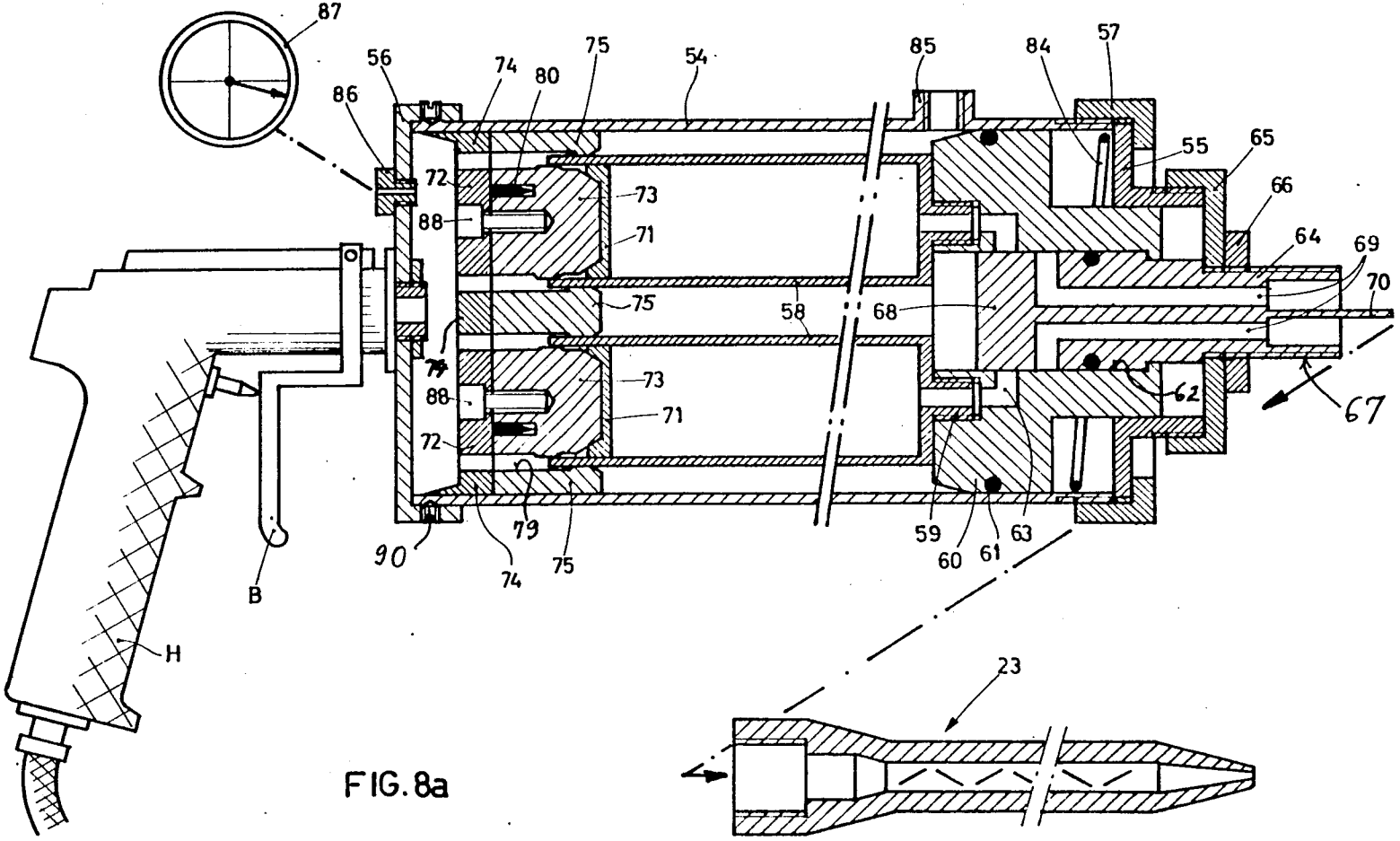
FIG. 8*a* is a sectional view of a further embodiment, adapted for being pneumatically actuated, of the device according to the invention, with parts in non-discharging or "closed" position.
Figure 8B:
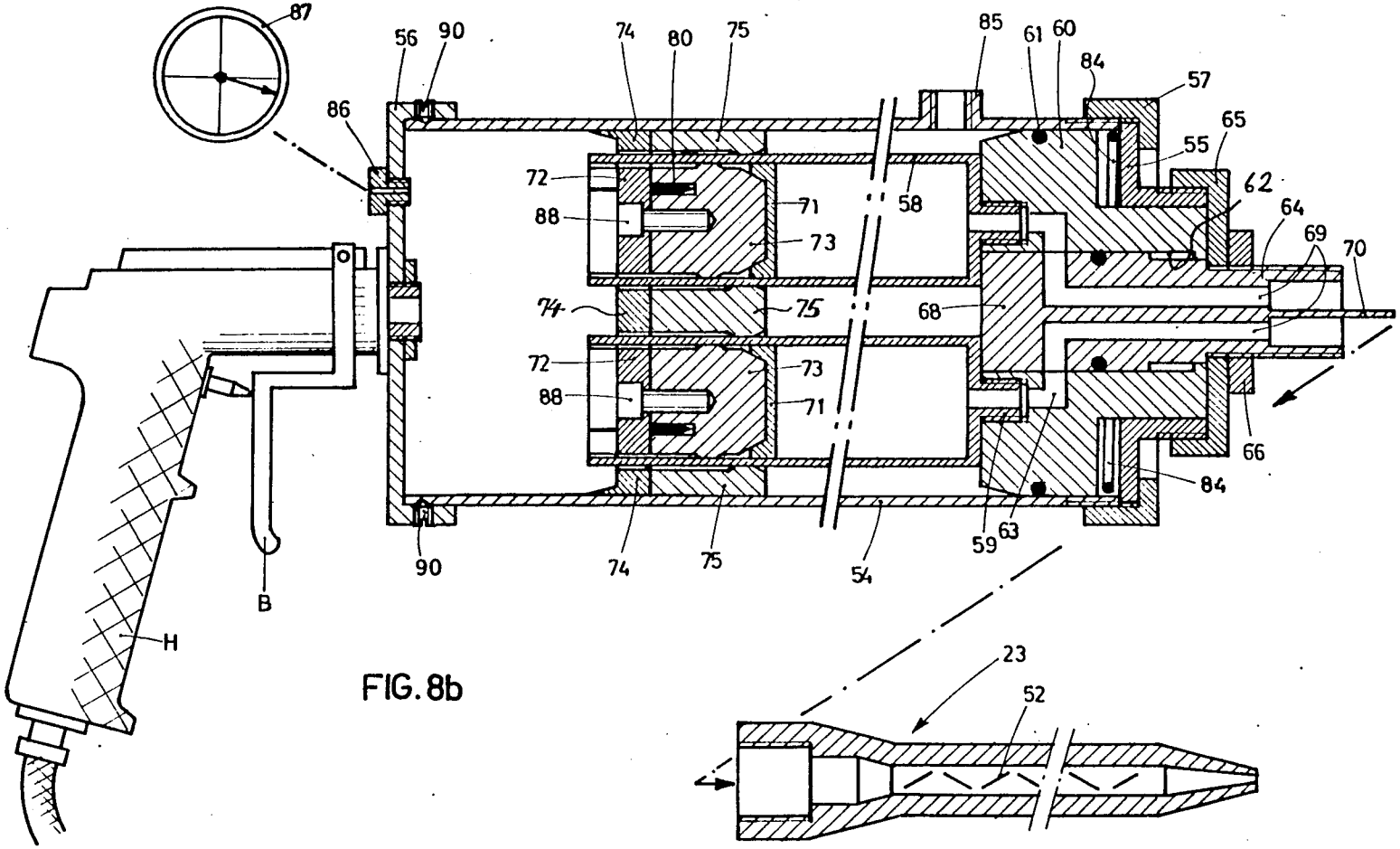
FIG. 8*b* shows the same view as FIG. 8*a*, but with the parts in dispensing position.

The above-enumerated drawbacks are avoided in a further embodiment of the dispensing device according to the invention which is shown in FIG. 8*a* in rest position and in FIG. 8*b* in working position. In this embodiment the housing consists of a tubular housing shell 54 to which there is fastened a front lid part 55 by means of a box nut 57, and a rearward back lid 56 fastened on the shell 54 by means of screws 90. Two cartridges 58 have at their front ends externally threaded outlet sleeves 59 by means of which they are firmly screw-connected with a cartridge sled 60 which is axially displaceably arranged in the housing shell 54. At its periphery the cartridge sled 60 bears an O-ring 61 sealingly engaging the inner surface of the forward zone of the shell 54.

The internal ducts in the outlet sleeves 59 open each into an angle duct 63 which extends axially over a short length and then turns radially inwardly to open in the inner wall of a central axial bore 62 of the cartridge sled 60.

The central bore 62 houses a valve body 64 which is screw-connected with a mounting cap nut 65 and secured in a central bore of the latter by means of a retaining nut 66. The mounting cap nut 65 is in turn screwed on to an externally threaded forwardly projecting sleeve part of the front lid part 55. Toward the rear the valve body 64 has an enlarged diameter valve head part 68 in the sidewall of which there open two valve channels 69 which lead from their orifices in the said sidewall radially inwardly and then axially forwardly to open into the mixing nozzle 23 which is adapted to be attached to the forward end of the valve body 64. At its forward end the valve body 64 bears a separating barrier piece 70 which protrudes into the rearward cavity in the mixing nozzle 23 and serves for maintaining the separation of the two components flowing through the two valve channels 69 until they enter the static mixing channel 52 of the nozzle 23.

Registration of the exits of angle ducts 63 with the entry orifices of channels 69 in the bore 62 of the cartridge sled 60 is ensured by conventional means such as a longitudinal groove in the periphery of the valve head 68 and a corresponding axial projection (not shown) in the bore 62.

At the rearward side of the back lid 56 there is fastened a holder H equipped with an actuating lever B, which holder serves to hold the dispensing device and for the admission of propellant gas. By means of the lever B, a valve (not shown) in the holder H can be actuated which controls the dosing of the propellant introduced into the device. Furthermore, a pressure gauge 87 can be mounted on a socket 86 provided in the back lid 56 in order to indicate the pressure prevailing in the device.

It is advantageous that the cartridges 58 are already equipped with the piston heads 71 which serve during shipping and storage as the rearward closures of the cartridges. Consequently, there is no need to exchange conventional closing lids of the known cartridges for pistons before use, for such manipulations can cause losses by leaking of components which may thus flow to undesirable sites in the interior of the housing or outside the device.

Figure 9A:
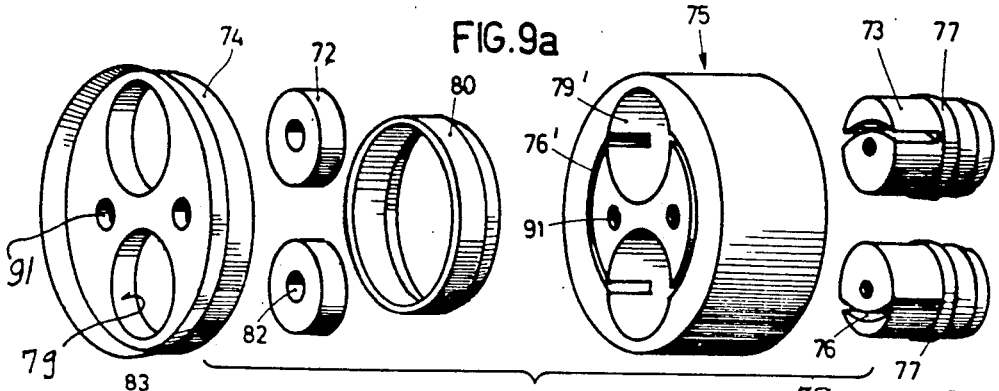
FIG. 9*a* is an exploded view in perspective of the parts constituting the piston means.
Figure 9B:
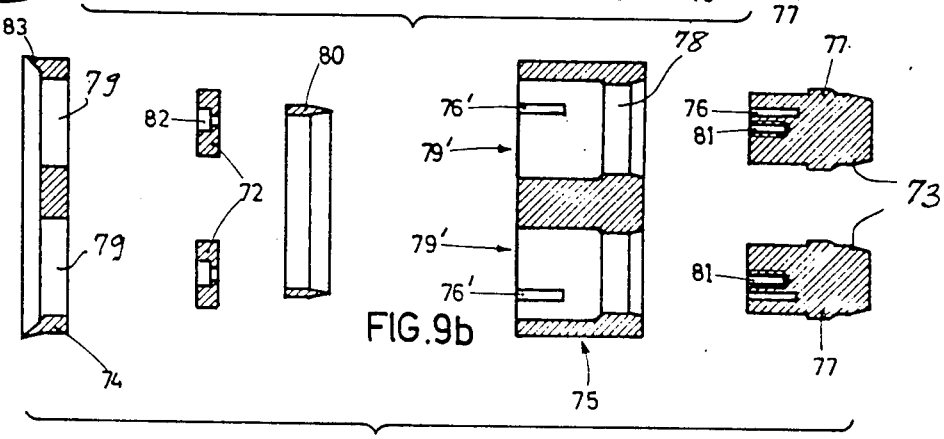
FIG. 9*b* is also an exploded view of the same parts as in FIG. 9*a*, but in axial section.

The pistons are built up from several parts. The aforesaid piston heads can be optionally supplied together with the cartridges. In order to actuate the piston heads 71 there is provided a composite piston unit with driving parts 72–75 which comprise rearward piston driving parts 72 and 74 that are subjectable to compressed air pressure, and pressure-transmitting intermediate piston stem parts 73 which can be introduced into the interior of the cartridges and engage at their frontal faces the rearward surfaces of the piston heads 71. The piston heads 71 are throw-away parts and are replaced when the contents of the cartridge has been consumed, while the driving piston parts 72 to 75 can be used repeatedly. Forward of the external driving part 74 which remains outside the cartridges there is provided a single sealing part 75 which is screw-connected with the external driving part 74 (FIGS. 9*a* and 9*b*). The composite piston unit 72 to 75 thus comprises the internal parts 72 and 73 in the interior of the cartridges and the external piston parts 74 and 75 which remain outside the cartridges and the latter of which surrounds them at least partially. A ring-shaped blade 80 serves to couple the internal piston parts 72 and 73 and via the latter also the piston heads 71 with each other, and at the same time constitutes the coupling means for the rearward internal and external driving parts 72 and 74 as well as for the external driving part 74 and the sealing part 75, due to the fact that the external driving part 74 is screw-connected with the sealing part 75 by means of axial screws (not shown) fitting into bores 91 (FIG. 9*a*), while the rearward piston driving parts 72 are connected with the corresponding piston stem parts 73 by means of threaded bolts 88 (FIG. 8*a*). Thanks to this assembly of separable piston parts, the piston-coupling ring blade 80 can be easily inserted, and just as easily replaced, if necessary, in the piston assembly. On the other hand, the several parts 72 to 75 together with the blade 80 can be manufactured as one integral part. A suitable material for the integral piston-and-blade element would be a thermoset of high resistance to compression.

A connecting socket 85 is provided in the shell 54 and opens in the interior space of the latter about the cartridges 58. It serves for the introduction of propellant gas for the purpose of returning the piston assembly of parts 72 to 75 to its rearward starting position.

Figure 10:
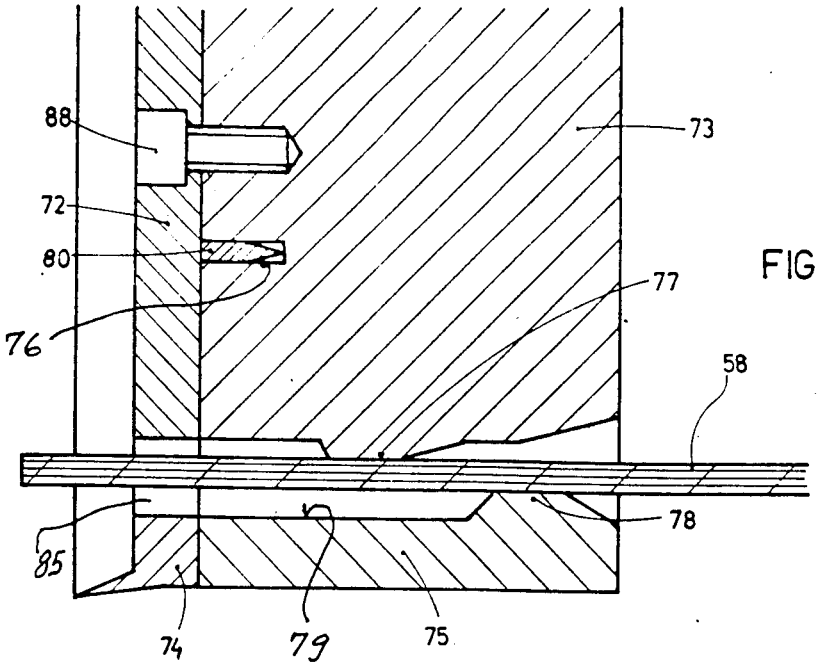
FIG. 10 is a partial, axially sectional view of the piston means shown in FIG. 9*b* when assembled.

The piston assembly of parts 72 to 75 is shown in detail and in an exploded view in FIGS. 9*a* and 9*b*. The intermediate stem parts 73 are provided each with an arcuate slot 76, which slots register with corresponding arcuate slots 76' in an external cylindrical sealing part 75. The ring blade 80 fits into the circular slot formed by the pairs of arcuate slots 76 and 87'. About its circumference each stem part 76 bears a radially projecting annular sealing rib 77 somewhat forward of the slot 76 in the respective stem part. The function of this rib 77 will be explained further below. A central bore hole 81 in each stem part 73 serves for receiving therein a threaded bolt 88 passing through the respective rearward driving part 72 and joining each pair of parts 72 and 73 firmly together (compare also FIG. 10). The external driving part 74 is provided with two parallel axial bores 79 symmetrically spaced from its central axis, and the sealing part 75 is provided with similar axial bores 79' registering with the bores 79 in the part 74, of which pairs of registering bores 79 and 79' each pair receives a set of fastened together internal driving and stem parts 72 and 73. In dimensioning the diameter of the bores 79 and 79' a gap 85 must be left about the parts 72 and 73 to provide for the insertion of the wall of the respective cartridge 58 (FIGS. 8*a* and 8*b*). The bores 79' in the sealing part 75 are each provided with a radially inwardly projecting bead 78 which is preferably arranged to be axially displaced rearwardly or preferably forwardly relative to the annular sealing rib 77 on the piston stem part 73, thus producing a double bending and sealing effect on the cartridge wall end which is inserted in the gap 85 between them (FIG. 10). The function of the boreholes 91 in the cylindrical sealing part 75 has already been explained, supra.

The parts shown in FIG. 10 have already been discussed, supra. The piston stem part 73 bears the arcuate slot 76 thereof in which the blade 80 is lodged and held in place by the rearward piston driving part 72 attached thereto by means of the threaded bolt 88 and covering the rearward open end of the slot 76.

The effective sealing of the sealing rib 77 on the internal face of the cartridge wall 58 is important in order to prevent propellant gas from penetrating forward to the piston head 71. Otherwise there would be the danger of propellant seeping into the space rearward of the piston head 71, which is only loosely placed on the piston stem part 73, and acting on the same to advance it at a rate different from the other piston 71, which would lead to inaccuracies in the prescribed mixing ratio of the components involved.

For, the considerable pressures generated in the cartridge when the piston assembly is actuated to move forward cause the cartridge to bulge outwardly. Moreover, small uneven areas and other small deviations of the cartridge wall from its ideal geometrical shape must be taken into account. For this reason there exists a real danger that the cartridge wall will be lifted off in places from the piston head 71 or even from the stem part 73. In both cases this would be risky because, when the wall of the cartridge 58 is lifted off the periphery of the piston stem part 73, there is the danger of the piston head 71 being separated from the stem part 73 and of the correct mixing ratio being no longer guranteed. If the wall of the cartridge 58 lifts off the periphery of the piston head 71, then substance to be dosed can penetrate into the region between the paths of the piston assembly 72 to 75.

The radially inwardly directed sealing bead 78 of the sealing part 75 exerts a pressure on the cartridge wall in the region between the stem part 73 and the piston head 71 which acts counter to a tendency of the wall of the cartridge 58 to lift off these parts.

In FIG. 12 the mounting means for the cartridges 58 and the valve body 64 in the embodiment of FIGS. 8*a* and 8*b* are shown in exploded perspective views. An upper and a lower cartridge 58 are screwed into corresponding bores of the cartridge sled 60 which is provided with a central bore 62 into which the valve body 64 fits with its larger diameter valve head 68. The cartridge sled 60 bears about its periphery the sealing O-ring 61. The front lid 55 is fastened by means of the box nut 57 on the forward end of the housing shell 54. The forward zone of the valve body 64 which protrudes forwardly from the central bore 62 of the cartridge sled 60 is provided with an external threading 67 and is held fast by the mounting cap nut 65 on the front lid 55 and secured thereon by the retaining nut 66. A restoring spring 84 biasses the cartridge sled 60 toward its rearward end position shown in FIG. 8*a*.

FIGS. 11 and 13 show in exploded perspective views a somewhat different embodiment of the piston assembly. Only the stem part 73 destined to be introduced into the upper bore 79' of the cylindrical sealing part 75 is shown in exploded position while the other stem part 73 is shown introduced into the lower bore 79'. Each stem part 73 is provided with three radial slots 92 arranged to form a three-armed star and destined to receive therein three correspondingly arranged blades 89.

FIG. 13 illustrates the introduction of the wall of a lower cartridge 58 into the gap provided between the inner wall surface of the bore 79 in the external driving part 74 and the periphery of the lower piston driving part 72, while in the case of the upper piston driving part 72 the gap is clearly visible, the upper cartridge being indicated only in dashed lines. It will be recognized that the wall of the lower cartridge 58 emerging to the left from the said gap has been cut by the blades 89 (FIG. 11) into three segments.

The variant of the piston assembly shown in FIGS. 11 and 13 operates in a manner similar to that illustrated in FIGS. 8*a* and 8*b*.

Actuation of the lever B in FIGS. 8*a* and 8*b* causes propellant gas to exert pressure on the piston assembly 72–75 which is transmitted to the piston heads 71. The surface area of the rearward face of the piston assembly 72–75 is larger than the frontal surface area of the piston head 71, the difference being equal to the annular rearwardly facing area of the external piston part 74, thereby providing a pressure transmission ratio corresponding to the ratio of those transverse piston face areas.

This is of particular importance in the case of pneumatic systems. In many countries legal safety rules permit only relatively low excess pressures for propellant-containing vessels. For instance, in Switzerland, a maximal pressure of only 6 bar is permitted. It has been found that, in practice, such low propellant pressures are not sufficient in particular for dispensing doses of highly viscous substances. Thus, the embodiment of a dispensing device illustrated in FIGS. 8*a* and 8*b* requires at least a dispensing pressure of 8 bar, in particular in view of the high pressures required for effectively using the mixing nozzle, if a satisfactory operation of the piston-equipped device is to be guaranteed. It is, however, possible, owing to the above-explained pressure transmission ratio, to achieve proper functioning when using the commercially available propellant pressure bottles having a maximum internal pressure of only 6 bar.

The functioning of the valve assembly shown in FIGS. 8*a* and 8*b* shall now be explained further. As long as each cartridge 58 remains in its rearmost position as shown in FIG. 8*a* the angle ducts 63 present in the cartridge sled 60 are separated from the channels 69 in the valve body 64, i.e. the valve is obturated. The contents of the cartridges cannot be expelled. Pressure applied to the piston assembly 72–75 and the piston heads 71 moves the cartridges 58 together with the cartridge sled 60 forward until the forward end position illustrated in FIG. 8*b* is reached. In this forward position shown in FIG. 8*b* the angle ducts 63 in the cartridge sled register with the channels 69 of the valve body, i.e., the valve is open. The rearward piston-driving parts 72, 73 can now penetrate, together with the piston heads 71, into the rearward portion of the cartridges 58 as the blades 80 or 89 cut into the cartridge walls, whereby the piston heads 71 expel desired doses of the substances contained in the cartridges 58 into the mixing nozzle 23. When the actuating lever B is released, the restoring spring 84 will urge the cartridge sled 60 together with the cartridges 58 toward their rearward end position and the valve is again closed by the valve head 68 obturating the piston exits of the angle ducts 63 in the inner wall surface of the cartridge sled bore 62. Thus, the valve means are closed each time when dispensing is interrupted.

Figure 14A:
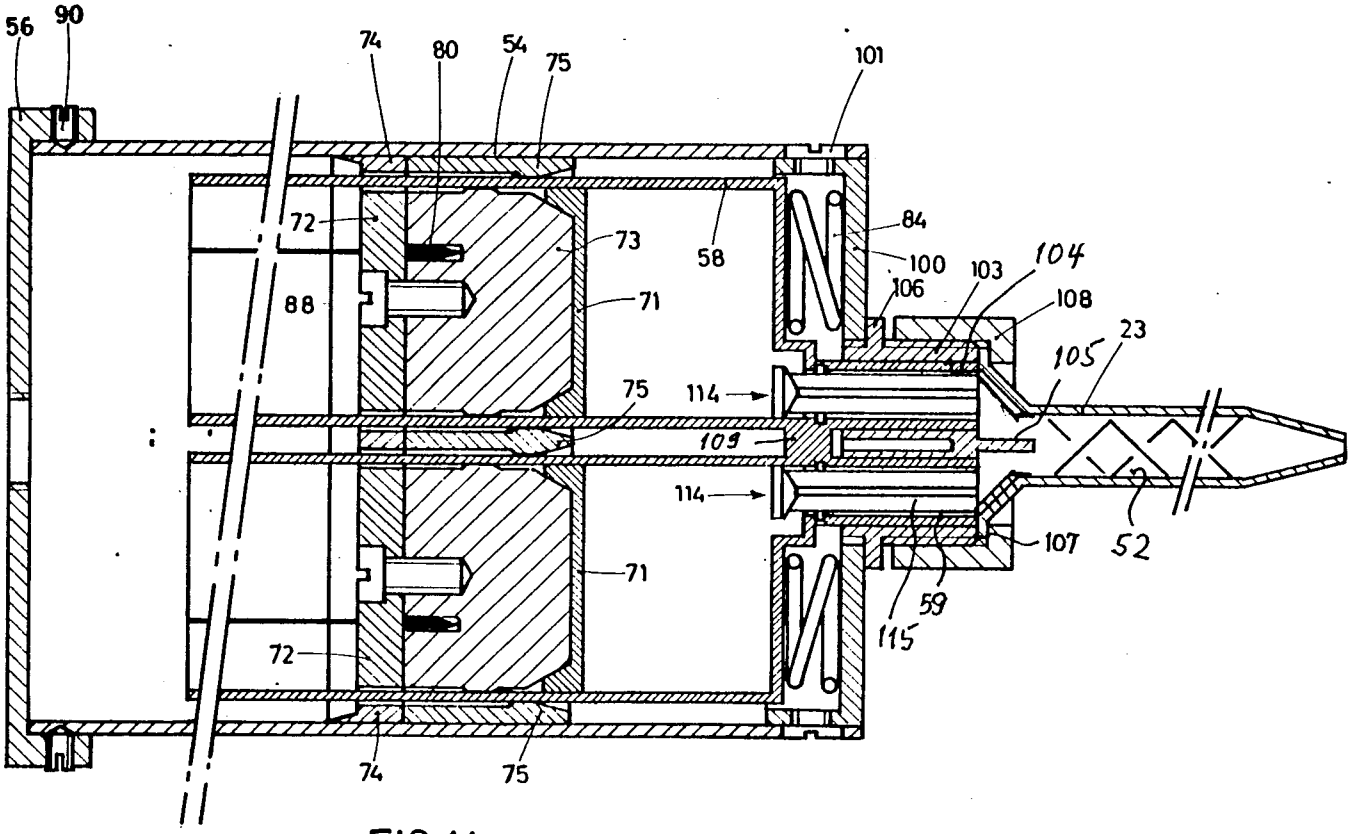
FIG. 14*a* is a schematical view, in axial section, of yet another embodiment of the dispensing device according to the invention, with the parts in dispensing, open position.
Figure 14B:
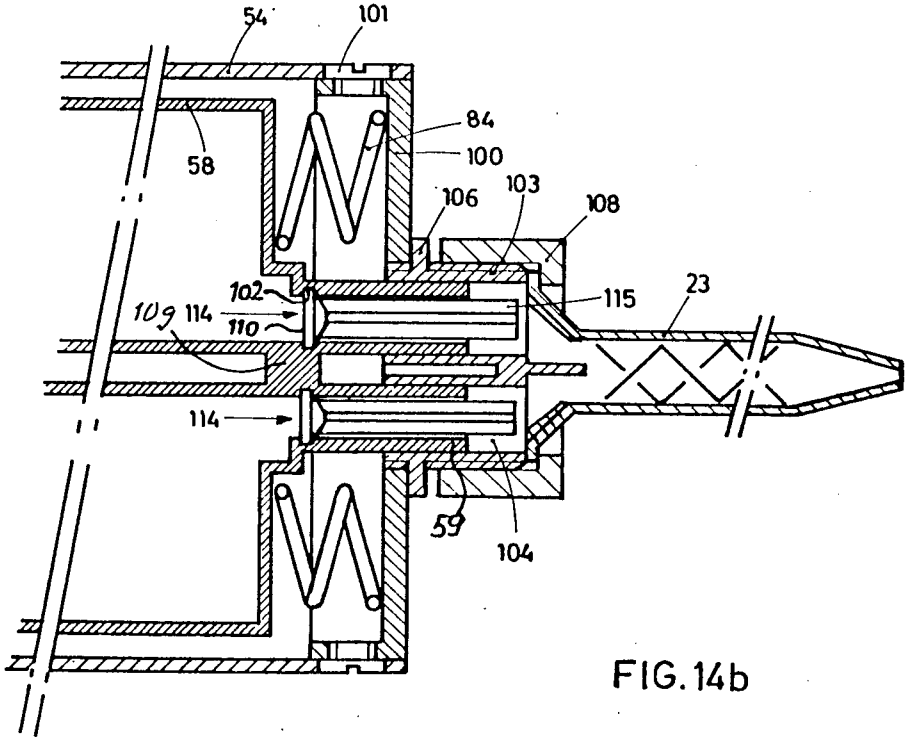
FIG. 14*b* is a schematical view similar to that of FIG. 14*a*, but with the parts in closed position, after dispensing.

In dispensing devices operating under high pressures the embodiment of such a device illustrated in FIGS. 14*a* and 14*b* is particularly suitable, inexpensive and easy to operate. The rearward part of the piston assembly inclusive of the piston heads is identical with that shown in FIGS. 8*a* to 13. Like parts in both embodiments bear like reference numerals and need not be explained again. However, the forward part of the device comprising the valve assembly and the cartridges shows considerable differences of structure.

Figure 15:
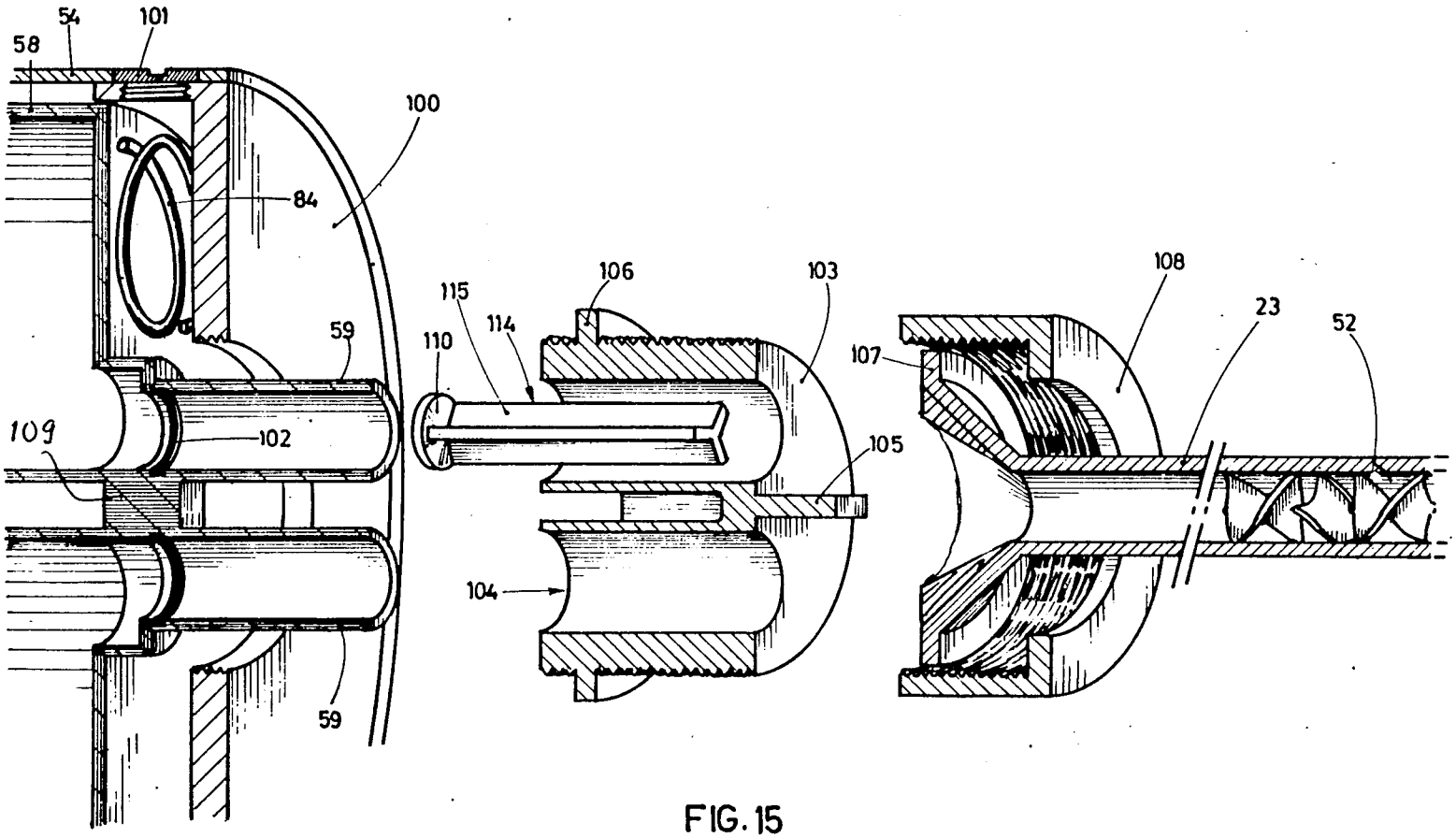
FIG. 15 is an exploded view, in perspective and in axial section, of a functional portion of the parts constituting the embodiment shown in FIGS. 14*a* and 14*b*.

Instead of being lodged in a common cartridge sled 60, the two cartridges 58 have their cartridge outlet sleeves 59 mounted in axial bores 104 of a common guide member 103. As shown in FIGS. 14*a*, 14*b* and 15, each cartridge 58 is equipped with a valve 114 comprising a valve stem 115 of Y-shaped cross section and a valve head 110 at the rearward end of the valve stem 115. The valve 114 of each cartridge 58 is lodged in the respective outlet sleeve 59 and is guided for axial displacement therein. The outlet sleeves 59 of the catridges 58 are themselves axially displaceably guided in the guide member 103 which is firmly screwed into a forward housing front wall 100 so as to abut securely with its annular external flange 106 against the frontal face of the front wall 100. The housing front wall 100 has a rearwardly axially extending peripheral flange which is inserted in the open forward end of the shell 54 and fastened therein by means of screws 101. A screw cap 108 is screwed on to the externally threaded forward end of the guide member 103 and holds an external flange 107 at the rearward end of the mixing nozzle 23 clamped in position on the forward end of the guide member 103. The guide member 103 bears at its forward end centrally between the bores 104 thereof, a planar nose part being a barrier wall 105 which separates the doses of components, being expelled from the outlet sleeves 59 of the cartridges 58 and emerging from the forward end of the guide member 103, from mixing with each other until they come into contact upon arriving at the static mixer 52 in the mixing nozzle 23.

In lieu of a screw cap 108 which constitutes an additional part to be manufactured, the forward part of the guide member 103 can be provided with slots or integral pegs (not shown) in which the rearward end of the mixing nozzle 23 which must be provided with corresponding integral pegs or slots (not shown) can be engaged, thereby providing a bayonet joint between the nozzle 23 and the front end of the guide member 103.

Further details concerning the embodiment of FIGS. 14*a*, 14*b* and 15 comprise flat internal annular grooves or notches 102 in the outlet sleeves 59 toward the rearward end zones thereof in which the rims of the valve heads 110 of the valve bodies 114 can engage in their rearward or valve-closing position (FIG. 14*b*). The cartridges are then in rearward end position which corresponds to that shown in FIG. 8*a*. The device can be shipped or stored safely with the valves in this closed position as the contents of the cartridges can not leak out.

When the piston assembly 71–75 is subjected to pressure by the admission of compressed air in the same manner as explained in connection with FIGS. 8*a* and 8*b*, the valve heads 110 of the valves 114 still remain engaged with their rims in the notches 102 inside the outlet sleeves 59 and with their forward stem ends still remote from the nozzle flange 107. As no contents can yet flow out of the cartridges 58 the latter are moved forward under full pressure. Only when the forward ends of the valve stems 115 abut on the rearward external flange 107 at the rear end of the mixing nozzle 23, will they be pushed out of their notches 102 in the still forward moving cartridge outlet sleeves 59 and free the rearward open ends of the outlet sleeves 59 as shown in FIG. 14*a*.

When the cartridges 58 have arrived at their forward end position (FIG. 14*a*) a desired dose of substances will be expelled into the free path to the mixing nozzle 23. In this working position the pressure on the piston assembly 71–75 will act as dispensing pressure. When external pressure on the piston assembly ceases by turning off the compressed air, the restoring spring 84 will urge the cartridges 58 back to their rearward end position while the residual excess pressure in the interior of the cartridges will cause the outflowing substance to prevent the valve bodies 114 from following the rearward movement of the cartridges 58 and return into engagement of the rims of their valve heads 110 with the notches 102 (FIG. 14*b*).

The excess pressure necessary for this operation is built up in the interior of a cartridge 58 in the following manner:

(a) when filling the contents into the cartridge some occlusion of air is unavoidable. This air will be compressed by the piston pressure;

(b) the cartridge walls are slightly expanded by the piston pressure and will tend to contract again;

(c) as the piston pressure ceases, the restoring spring urges the cartridge 58 back to the rearward end position, and in doing so, the external piston parts 73 and 75 meet with frictional resistance during their displacement along the cartridge wall and thus continue to transmit residual pressure on the substances in the cartridges via the piston heads 71.

The pressure components mentioned in (a) to (c), supra, cause the substances in the interior of the cartridges 58 to exert pressure on the valve heads 110 when the passages bypassing the valve heads 110 in the open valve position (FIG. 14*a*) toward the ducts between the ledges of the Y-shaped valve stem 115 are sufficiently narrow to prevent substance pressure on the forward conical face of the valve head 110 from balancing or exceeding the substance pressure on the flat back face of the valve head 110. When the last-mentioned pressure by substance exceeds that on the conical forward face of its valve head, the respective valve body 114 will be pushed into its outlet sleeve 59 until it engages the notch 102 therein and thus interrupts substance flow from the cartridge completely. In order to ensure that the displacements of the two cartridges 58 always take place in unison they can be molded integrally with a bridge 109 combining them, thus equalizing any irregular action of the spring 84 thereon.

The dispensing device according to the invention is also suitable for systems comprising more than two chambers. The system comprising a cartridge sled is particularly suitable in this case, as more than two cartridges can be easily mounted in the sled side by side, in analogy with embodiments shown in FIGS. 8*a*, 8*b* and 14*a*, 14*b*. A kit can be devised comprising a large number of screw-connectable or otherwise insertable cartridges (e.g. nine), but, depending on the particular case, only a smaller number of the cartridges, e.g. three, will be attached at the same time to the sled 60 or introduced into the guide member 103. Of course those cartridges of the kit which are not yet in use will have to be well sealed against leaking of their contents.

The cartridges can also be arranged in sets in which they are connected with each other by bridging means provided near or at their outlet sleeves (e.g. the bridge 109 in FIG. 15). Thereby, a mix-up when inserting two or three new cartridges can be avoided.

The embodiments of the dispensing device according to the invention which have been described hereinbefore reveal that a number of alternatives as far as the coupling of pistons in the piston assembly, or the arrangement of the valves, as well as in the arrangement and configuration of the cartridges themselves comes within the scope of the present invention. Moreover, practically all of the parts of the device can be manufactured from inexpensive synthetic resin materials and can be easily assembled. The cartridges or parts thereof are advantageously equipped with valves and pistons at the time of being filled with their contents. The valves and pistons will then prevent leakages of the contents and guarantee safe shipping.

A further embodiment of the dispensing device according to the invention shall be discussed somewhat more in detail. In this embodiment, a cylindrical cartridge body is subdivided by one or several dividing walls, which extend longitudinally in the cartridge interior, into a number of chambers, in the same manner as described, for instance, in the European Pat. No. 119,847. However, in this European patent, the blades which are comprised therein serve exclusively for preparing the separating wall, by slitting the same, in a suitable manner for a treatment by deforming means which are applied to roll up, deflect out of the way, or otherwise remove the slit dividing wall sufficiently to free the path in an operative range for the piston-driving or coupling means, before the last-mentioned means are set in motion.

In contrast thereto, the blade means provided in the device according to the present invention serve for coupling the pistons in the several cartridges directly together, thus eliminating special wall-deforming and coupling means required in the device of the last-mentioned European patent and saving useful space in the interior of the housing of the device.

The embodiment of the pistons according to the invention which is illustrated in FIGS. 9*a* and 9*b* can be readily adapted for use with cartridges having longitudinally extending internal dividing walls.

The external piston driving and sealing parts 74 and 75 will be provided in this case with a single central bore 79 and 79', respectively, to receive therein the outlet sleeve of a single cartridge. Depending on the configuration of the cross sectional area of each of the internal chambers into which the cartridge is subdivided, the piston heads 71 and the internal parts 72 and 73 of the piston assembly for driving them will be adapted accordingly, e.g. when there are two internal chambers separated by a single dividing wall and having each a semi-circular cross section, the internal piston parts including the piston head 71 will have cross-sectional areas of the same configuration and will be coupled by accordingly curved blades, i.e. half circular blades readily prepared as halves of the blade 80 (FIGS. 9*a* and 9*b*). If the operation of the device is by pneumatical means, use of a pressure transmission ratio increasing the pressure exerted by the piston head on the substance in the respective chamber vis-á-vis the propellant pressure will be advantageous. In that case the external piston parts will have annular configuration, as the subdivided cartridge is optimally arranged centrally therein. In the case of only two chambers and a single dividing wall, there can be used a single straight blade 19 which can be lodged in a straight slot therefor provided in the piston stem part 73 and the external sealing part 75, for coupling them together. When more than two chambers and correspondingly more than one subdividing wall is present in the cartridge, the blades will be of appropriate shape and will be lodged in accordingly shaped slots in the two lastmentioned parts.

The valve arrangement described in connection with FIGS. 14*a*, 14*b* and 15 can also be readily adapted to the last-discussed special case of a single cartridge being subdivided into several chambers. Thus the two chambers having circular cross-sectional areas in two different cartridges, will, for instance, be replaced by two chambers each of semi-circular cross-sectional area, in a single cartridge which chambers are separated from each other by a single planar dividing wall. The outlet sleeves of the two chambers of the cartridge are preferably of the same shape and arrangement, slightly spaced apart from each other, that is shown in the embodiment of FIGS. 14*a*, 14*b* and 15. The passages through the outlet sleeves may, however, have semi-circular or other cross-sectional areas, and the piston assembly and valve arrangement may readily be adapted to fit a cartridge containing more than two different chambers.

Furthermore, the piston assembly and the valve arrangement can also be adapted readily for use in systems comprising only one single-chamber cartridge. The piston assembly is used in this case for producing a pressure transmission with a ratio changing the pressure of the piston head on the substance in the cartridge vis-á-vis the available propellant pressure in a desired manner, for instance increasing piston head pressure when a highly viscous slowly flosing substance is to be expelled and only a propellant of relatively low pressure is available for reasons of safety. As the valve system as described hereinbefore works automatically, valves of single-chamber systems which were sometimes left open with corresponding loss of product should be a matter of the past.

It will be understood from the foregoing that the piston assemblies as well as the valve systems described as parts of the dispenser of the invention are adaptable to a random number of cartridge types.

The invention comprises a large number of further variations. Thus, it is not absolutely necessary to couple the pistons by means of the wall-cutting elements. In cases where very fine cutting elements such as very thin blades or cutting wires are of special advantage, the coupling of the pistons can also be achieved by sturdier coupling means such as a coupling flange arranged to the rear of the cutting element or elements. However, it is a firm rule that the thickness of the coupling member should correspond substantially to that of the cutting element so that the former can pass comfortably through the slit in the cartridge wall cut by the latter; without generating an excessive friction or undue deformation of the wall portions adjacent the slit.

As far as the described valve control means are concerned, the considerable number of variations are likewise suitable. For instance, the relative movement between the cartridges and the housing of the device can (a) be transferred to a cartridge sled which constitutes a part of the valve as shown in FIGS. 8*a* and 8*b;*

(b) be used for the control and actuation of valves which are devised independently of the cartridges or of an optionally present cartridge sled and whose direction of movement can be different from that of the cartridges.

A control of the valves dependent on the relative movement of the cartridges with regard to the housing ensures that the valve will open only after a sufficient discharge pressure has been built up in the interior of the cartridge.

The inventive feature of having the valve heads lodged in the outlet sleeves of the cartridges and have them engaged in stop means therein after each dosing or dispensing operation permits removal of a partly used-up cartridge from the dispensing device and storing it for later re-use, as the valves 114 serve as the forward, and the piston head 71 as the rearward closure elements sealing in the contents of the cartridge. An exchange of the cartridge thus requires only a simultaneous exchange of the cartridge-guiding member and of the mixing nozzle which can both be devised as throw-away elements.

Instead of a propellant drive or a pawl drive there can also be used an electrical spindle drive. As the latter is very inexpensive, a separate spindle drive can be provided for each cartridge. In this case the connection of the pistons with each other by a cutting element can be dispensed with.

However, when controlling the spindle drive it is necessary to provide for correct reclosing of the valves and their re-engagement with stop means in the outlet sleeves of the cartridges. To satisfy this condition, it is necessary that the spindle drive is either programmed to carry out automatically a few turns in the opposite sense of rotation at the end of each dispensing step, or that it be relieved in any other suitable manner, e.g. by lifting the spindle off the rack.

What is claimed is:

1. A dispensing device for storing and applying at least one liquid or pasty substance, which device comprises a housing;

a dispensing nozzle attached thereto;

at least one cartridge adapted for being lodged in the interior of said housing and having cartridge wall means adapted for enclosing contents of at least one substance therein, and a discharge outlet; said cartridge being longitudinally displaceable between a rearward and a forward end position in said housing;

a piston assembly comprising at least one piston for expelling a quantity of the aforesaid substance from said cartridge;

mounting means for said at least one cartridge in said housing;

at least one valve means for controlling dispensing of contents of said cartridge therefrom; said valve means being associated with said cartridge and said housing in a manner such that said valve means are closed in said rearward end position, and said valve means are open in said forward end position of said cartridge;

means for displacing said cartridge and said piston assembly in a forward direction; and restoring means for returning said cartridge from a forward position to said rearward end position thereof.

2. The dispensing device of claim 1, wherein said mounting means comprise a cartridge sled in which said at least one cartridge is inserted with said discharge outlet thereof; said valve means being coupled with said cartridge via said cartridge sled.

3. The dispensing device of claim 1, wherein said restoring means comprises a forward inlet socket for compressed air.

4. The dispensing device of claim 1, wherein said restoring means comprises a restoring spring.

5. The dispensing device of claim 1, wherein said mounting means comprise a cartridge sled and said valve means comprise a valve body, said at least one cartridge being mounted via the discharge outlet thereof in said cartridge sled; and each of said cartridge sled and said valve body comprise duct means adapted for registering with each other for the passage of cartridge contents therethrough when said cartridge is in a forward position, and said passage of cartridge contents through said duct means is obturated when said cartridge is in rearward end position.

6. The dispensing device of claim 1, wherein said cartridge comprises mouthpiece means surrounding said discharge outlet, and said valve means comprise at least one valve body and a valve head at the rearward end of said valve body, said valve body being lodged in said mouthpiece means and adapted for axial displacement therein;

said valve head being adapted for obturating a flow of cartridge contents from an associated cartridge through said mouthpiece means when said valve head is inside said mouthpiece and said valve means is closed; and said valve head is displaced rearwardly out of said mouthpiece means into the interior of said cartridge associated therewith when said valve means are open.

7. The dispensing device of claim 6, wherein said mouthpiece means comprise notch means adapted for engaging said valve head when said valve means are closed.

8. The dispensing device of claim 6, wherein said valve means comprise a valve stem a part of which protrudes forwardly from said mouthpiece means when said valve is closed, the length of said protruding valve stem part corresponding to the length of travel of said cartridge between said rearward end position and said forward end position thereof; and said housing comprises abutment means stationary therein and being located forward of said forwardly protruding valve stem part, said forwardly protruding valve stem part being adapted to abut against said abutment means at a point of forward travel of said cartridge intermediate said forward and rearward end positions thereof, thereby shifting the relative position of said valve head rearwardly out of said mouthpiece into the interior of said cartridge and opening said valve means.

9. The dispensing device of claim 8, wherein said valve head and a portion of said cartridge and said mouthpiece means adjacent said valve head are of a configuration such that, when said cartridge travels toward said rearward end position thereof, residual contents pressure in the interior of said cartridge produced by said at least one piston suffices to return said valve head into obturating position in said mouthpiece means, thereby closing said valve means.

10. The dispensing device of claim 8, wherein said abutment means are constituted by a radially outwardly extending flange at the rearward end of said dispensing nozzle, said flange being mounted stationary on said housing.

11. A dispensing device for storing and applying at least one liquid or pasty substance, which device comprises a housing;

a dispensing nozzle attached thereto;

at least one cartridge adapted for being lodged in the interior of said housing and having cartridge wall means adapted for enclosing contents of at least one substance therein, and a discharge outlet; said cartridge wall means comprising at least one cuttable cartridge wall being manufactured at least partially from cuttable material;

said at least one cartridge being longitudinally displaceable between a rearward and a forward end position in said housing;

a piston assembly comprising at least two pistons by said cuttable cartridge wall and having frontal faces adapted for exerting pressure on said cartridge contents and extending up to a forward end plane;

a piston-coupling unit adapted for connecting said at least two pistons with each other for joint displacement in said housing;

at least one cutting member being mounted behind said forward end plane of said frontal faces of said two pistons and serving for cutting through said cuttable cartridge wall between said pistons;

guiding means for said at least one cartridge in said housing;

at least one valve means for controlling dispensing of contents of said cartridge therefrom; said valve means being associated with said cartridge and said housing in a manner such that said valve means are closed in said rearward end position, and said valve means are open in said forward end position of said cartridge;

means for displacing said at least one cartridge and said piston assembly in a forward direction; and a restoring means for returning said cartridge from said forward position to said rearward end position thereof;

said piston assembly having slot means, associated with said pistons thereof, of a cross sectional area and configuration such that said cuttable cartridge wall can pass thereinto, and can pass therethrough after having been cut.

12. The dispensing device of claim 11, wherein said cutting member and said piston-coupling unit are an integral part.

13. The dispensing device of claim 11, wherein said piston-coupling unit comprises connecting flange means arranged rearwardly of said at least one cutting member and being adapted for passing through a slit, cut by said cutting member in said cuttable cartridge wall, with low friction.

14. The dispensing device of claim 11, wherein said cuttable cartridge wall is made at least partially of a cuttable material selected from polyethylene, polypropylene and polybutylene terephthalate.

15. The dispensing device of claim 14, wherein the pistons comprised by said piston assembly are made from polybutylene terephthalate.

16. The dispensing device of claim 11, wherein a single cartridge is lodged in said housing and said cartridge wall means comprise an internal cuttable separating wall subdividing the interior of said single cartridge into a central substantially cylindrical chamber and at least one annular cylindrical chamber disposed about said central chamber coaxially therewith, and said piston assembly comprises a central piston introduced into said central chamber, and an annular piston of appropriate annular cross sectional area, introduced into a corresponding annular chamber.

17. The dispensing device of claim 11, wherein a single cartridge is lodged in said housing and said cartridge wall means comprise at least one internal cuttable separating wall subdividing the interior of said single cartridge into at least two longitudinally extending chambers, and said piston assembly comprises at least two separate pistons being respectively lodged in said at least two chambers.

18. The dispensing device of claim 11, wherein said guiding means comprise a cartridge holder, and wherein said cartridges are mounted each via the discharge outlet thereof in said cartridge holder.

19. The dispensing device of claim 11, wherein said piston assembly is adapted for being propelled from a rearward end position in said housing toward a forward end position in said cartridge and comprises at least one rearward piston face destined for being subjected to forward-propelling forces from behind said piston assembly, the total size of said at least one rearward piston face being larger than the total size of said frontal piston faces.

20. The dispensing device of claim 19, wherein said piston assembly comprises at least one internal piston adapted for being lodged in the interior of a cartridge, and at least one external piston adapted for being located outside and surrounding at least one such cartridge.

21. The dispensing device of claim 20, wherein at least one such internal piston and at least one such external piston are connected with each other by at least one cutting member.

22. The dispensing device of claim 20, wherein at least each of said pistons of said piston assembly bearing a frontal face adapted for exerting pressure on said cartridge contents comprises sealing means adapted for sealingly radially engaging inner wall surfaces of said cartridge wall means inside said cartridge.

23. The dispensing device of claim 19, wherein said piston assembly comprises at least one first set of internal pistons adapted for being lodged in sequence in a cartridge, and a second set of external pistons adapted for being located outside and surrounding at least one such cartridge, first sealing means associated with at least one internal piston in said first set, and second sealing means associated with an external piston of said second set, said first sealing means associated with said internal piston being spaced from said second sealing means associated with said external piston in axial direction.

24. The dispensing device of claim 23, wherein said first sealing means are adapted for radially engaging the inside of said cartridge wall means adjacent said internal piston, and said second sealing means are adapted for radially engaging the outside of the same adjacent wall means in a region thereof spaced forward of said sealing means of said internal piston in a middle zone between said second sealing means and said internal piston having a frontal face adapted for exerting pressure on said cartridge contents.

25. The dispensing device of claim 20, wherein said housing comprises propellant inlet means located at a site in said housing, outside said cartridges, appropriate for applying propellant pressure on said external piston at a forward face thereof, thereby returning said piston assembly from a forward to a rearward position in relation to said cartridges and said housing.

26. The method of using the dispensing device of claim 25 comprising discharging component contents therefrom with the aid of a propellant source having an internal excess pressure of at most 6 bars.

* * * * *